US008799198B2

(12) United States Patent
Purwanto et al.

(10) Patent No.: US 8,799,198 B2
(45) Date of Patent: Aug. 5, 2014

(54) BOREHOLE DRILLING OPTIMIZATION WITH MULTIPLE CUTTING STRUCTURES

(75) Inventors: Arifin Purwanto, Kingwood, TX (US); David P. Moran, The Woodlands, TX (US); Lei Yan, Spring, TX (US)

(73) Assignee: Smith International, Inc., Houston, TX (US)

( * ) Notice: Subject to any disclaimer, the term of this patent is extended or adjusted under 35 U.S.C. 154(b) by 513 days.

(21) Appl. No.: 12/732,301

(22) Filed: Mar. 26, 2010

(65) Prior Publication Data

US 2011/0232968 A1 Sep. 29, 2011

(51) Int. Cl.

| | |
|---|---|
| ***G06E 1/00*** | (2006.01) |
| ***G06E 3/00*** | (2006.01) |
| ***G06F 15/18*** | (2006.01) |
| ***G06G 7/00*** | (2006.01) |
| ***G06N 3/02*** | (2006.01) |

(52) U.S. Cl.
USPC ..... 706/15

(58) Field of Classification Search
USPC ..... 175/27; 706/15, 16
See application file for complete search history.

(56) References Cited

U.S. PATENT DOCUMENTS

| | | | | |
|---|---|---|---|---|
| 6,424,919 | B1 * | 7/2002 | Moran et al. | 702/6 |
| 6,732,052 | B2 | 5/2004 | Macdonald et al. | |
| 6,785,641 | B1 | 8/2004 | Huang | |
| 6,789,620 | B2 | 9/2004 | Schultz et al. | |
| 7,020,597 | B2 | 3/2006 | Oliver et al. | |
| 7,142,986 | B2 | 11/2006 | Moran | |
| 7,261,167 | B2 | 8/2007 | Goldman et al. | |
| 7,357,196 | B2 | 4/2008 | Goldman et al. | |
| 7,412,331 | B2 | 8/2008 | Calhoun et al. | |
| 7,613,665 | B2 | 11/2009 | Chen et al. | |
| 2004/0221655 | A1 * | 11/2004 | Chen et al. | 73/708 |
| 2005/0211470 | A1 * | 9/2005 | Jeffryes | 175/27 |
| 2007/0185696 | A1 | 8/2007 | Moran et al. | |
| 2008/0262810 | A1 * | 10/2008 | Moran et al. | 703/10 |

OTHER PUBLICATIONS

'Sophisticated ROP prediction technologies based on neural network delivers accurate drill time results': Moran, 2010 IADC/SP E.*
UK Patent application BG 2422696, Moran, 2006.*
Application of oxley machining theory to boring and reaming: McKendrick, 2006, Machininf Science and Technology: An international journal, vol. 5, Issue 3, pp. 375-391.*

* cited by examiner

*Primary Examiner* — Kakali Chaki
*Assistant Examiner* — Peter Coughlan

(57) ABSTRACT

A method of optimizing a drilling operating parameter or a drilling system parameter for a drilling assembly employing at least first and second distinct cutting structures includes entering at least one design parameter for each of the cutting structures into a trained artificial neural network. At least one of the design parameters of the first cutting structure may be optionally combined with at least one of the design parameters of the second cutting structure. The combined design parameter may also be entered into the artificial neural network.

24 Claims, 4 Drawing Sheets

10
12
20
30
18
22
16
40
56
50
52

BOREHOLE DRILLING OPTIMIZATION WITH MULTIPLE CUTTING STRUCTURES

RELATED APPLICATIONS

None.

FIELD OF THE INVENTION

The present invention relates generally to wellbore drilling operations. Embodiments of this invention relate to methods for selecting drilling parameters to improve drilling performance, particularly in drilling operations employing multiple cutting structures (such as a drill bit and a hole opener or underreamer).

BACKGROUND OF THE INVENTION

Wellbore drilling, such as is used for petroleum exploration and production, includes rotating a drill bit while applying axial force to the drill bit. The rotation and the axial force are typically provided by equipment which includes a drilling "rig". As is known to those of ordinary skill in the art, the rig includes various devices to lift, rotate, and control segments of drill pipe which ultimately connect the drill bit to the equipment on the rig. The drill pipe includes a through bore through which drilling fluid is pumped. The drilling fluid discharges through orifices in the bit ("jets") for the purposes of cooling the drill bit and lifting rock cuttings out of the wellbore as it is being drilled.

The speed and economy with which a wellbore is drilled, as well as the quality of the borehole, depend on a number of factors. These factors include, among others, the mechanical properties of the rocks which are drilled, the diameter and type of the drill bit used, the flow rate of the drilling fluid, and the rotary speed and axial force applied to the drill bit. In general, for any particular mechanical property of a formation, the rate of penetration (ROP) of a drill bit tends to be related to the axial force on and the rotary speed of the drill bit. The rate at which the drill bit wears out also tends to be related to the ROP. Various methods have been developed to select drilling parameters to achieve certain desirable results, for example, improved ROP and reduced drill bit wear.

Commonly assigned U.S. Pat. No. 6,424,919 ("the '919 patent") discloses a method of selecting a drill bit design parameter by inputting at least one property of a formation to be drilled into a trained Artificial Neural Network (ANN). The '919 patent also discloses that a trained ANN may be used to determine optimum drilling operating parameters for a selected drill bit design in a formation having particular properties. The ANN may be trained using data obtained from laboratory experimentation or from existing wells that have been drilled near the present well, such as an offset well.

ANNs are known to emulate the neuron interconnection architecture of the human brain to mimic the process of human thought. By using empirical pattern recognition, ANNs have been applied in many areas to provide sophisticated data processing solutions to complex and dynamic problems (e.g., classification, diagnosis, decision making, prediction, voice recognition, and military target identification).

Similar to the human brain's problem solving process, ANNs use information gained from previous experience and apply that information to new problems and/or situations. The ANN uses a "training experience" (e.g., including a training data set) to build a system of neural interconnects and weighted links between an input layer (independent input variables), a hidden layer of neural interconnects, and an output layer (at least one dependent output variable or result). No existing model or known algorithmic relationship between these variables is required, but such relationships may be used to assist in training the ANN when available. An initial determination of the output variables in the training exercise is compared with the actual values in a training data set. Differences are back-propagated through the ANN to adjust the weighting of the various neural interconnects, until the differences are reduced to the user's error specification. Due largely to the flexibility of the learning algorithm, non-linear dependencies between the input and output layers can be "learned" from experience.

Commonly assigned, co-pending U.S. patent application Ser. No. 11/670,696 (U.S. Patent Publication 2007/0185696) discloses a method for determining optimized drilling parameters in substantially real-time during drilling. Data is collected from the well while drilling and employed in a drilling optimization system. The data may include, for example, lithologic and compression data obtained from cuttings, logging and measurement while drilling data, ROP data, drilling fluid composition, and the like. The optimization system has access to or includes various ANNs suitable for determining optimized drilling parameters based on historical and real-time data.

While the above described methods for determining drilling parameters have been utilized commercially, there is room for further improvement. For example, the above described prior art methods are configured for a bottom hole assembly (BHA) including only a single cutting structure (e.g., a conventional drill bit deployed at the lower end of the BHA). However, BHA configurations that employ two (or even three) distinct cutting structures (e.g., a drill bit and one or more hole openers or underreamers) are commonly employed. These cutting structures typically include distinct cutting surfaces, and being longitudinally spaced in the BHA, commonly simultaneously cut distinct formation lithologies having correspondingly distinct physical properties. Therefore there is a need in the art for improved drilling optimization methods, and particularly for drilling optimization methods that are suitable for use with a BHA configuration having multiple cutting structures.

SUMMARY OF THE INVENTION

Aspects of the present invention are intended to address the above described need for improved drilling optimization methods. Methods in accordance with the present invention are configured to be used with drilling assemblies employing at least two distinct cutting structures (e.g., a drill bit and a hole opener or underreamer). In one exemplary embodiment, the invention includes a method for optimizing a drilling operating parameter. At least one design parameter for each of the first and second cutting structures is entered into a trained artificial neural network (ANN). In preferred embodiments of the invention, at least one of the design parameters of the first cutting structure is combined with at least one of the design parameters of the second cutting structure. This combined design parameter is also entered into the ANN. In another exemplary embodiment, the invention includes a method for optimizing a plurality of drilling system design parameters.

Exemplary embodiments of the present invention may advantageously provide several technical advantages. For example, methods in accordance with the present invention are configured for drilling operations that utilize at least first and second cutting structures. By taking into account the distinct design parameters of these cutting structures, the present invention tends to provide improved accuracy and efficiency. This in turn provides for improved drilling performance, for example, via improved rate of penetration, better managed life of the cutting structures (controlled wear), longer contiguous drilled intervals, and a reduced number of tool failures.

The invention further tends to provide for a reduction in destructive vibrational forces during drilling. Those of ordinary skill in the drilling arts will readily appreciate that the use of multiple cutting structures (e.g., a drill bit and a hole opener or underreamer) sometimes causes extreme and unpredictable vibration of the BHA. The present invention tends to better predict these unstable drilling conditions and therefore tends to reduce damage to and premature failure of the various BHA tools and tool connections. Reduced vibration also tends to improve borehole quality, resulting in a smoother, more continuous borehole wall, which in turn tends to simplify subsequent casing operations.

Moreover, certain exemplary embodiments of the invention advantageously combine at least one design parameter of the first cutting structure with at least one design parameter of the second cutting structure. The use of one or more combined design parameters tends to further improve the accuracy and predictive capability of the method, for example, by taking into account interactions and synergies between the cutting structures. The use of combined design parameters may be further advantageous in that it can reduce the time required to train the artificial neural networks.

Aspects of the present invention include a method for optimizing a drilling operating parameter and a method for optimizing a drilling system. The methods include entering a plurality of drilling system design parameters into a trained artificial neural network. The drilling system includes first and second longitudinally spaced cutting structures and the design parameters include design parameters for the first cutting structure and design parameters for the second cutting structure. At least one property of an earth formation to be drilled by the drilling system and at least one drilling operating parameter are also entered into the trained artificial neural network. In a method for optimizing a drilling operating parameter, a value of at least one of the drilling operating parameters is adjusted in response to an output of the trained artificial neural network so as to optimize the drilling operating parameter. In a method for optimizing a drilling system, a value of at least one of the drilling system design parameters is adjusted in response to an output of the trained artificial neural network so as to optimize the drilling system design parameter.

In another aspect, the present invention includes a method for optimizing a drilling operating parameter. A plurality of drilling system design parameters is acquired. The drilling system includes first and second longitudinally spaced cutting structures and the design parameters include at least one design parameter for the first cutting structure and at least one design parameter for the second cutting structure. The at least one design parameter of the first cutting structure is processed in combination with the at least one design parameter of the second cutting structure to obtain at least one combined design parameter. The combined design parameter into the trained artificial neural network along with at least one property of an earth formation to be drilled by the drilling system, and at least one drilling operating parameter. A value of the at least one drilling operating parameter is adjusted in response to an output of the trained artificial neural network so as to optimize the drilling operating parameter.

In still another aspect, the present invention includes a method for training an artificial neural network. An artificial neural network is provided. Training data from at least one previously drilled borehole is selected. The training data includes corresponding values of a plurality of drilling system design parameters, the drilling system design parameters including at least one design parameter for a first cutting structure and at least one design parameter for a second cutting structure. The at least one design parameter of the first cutting structure is processed in combination with the at least one design parameter of the second cutting structure to obtain at least one combined design parameter. The at least one combined design parameter is then entered into the artificial neural network.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
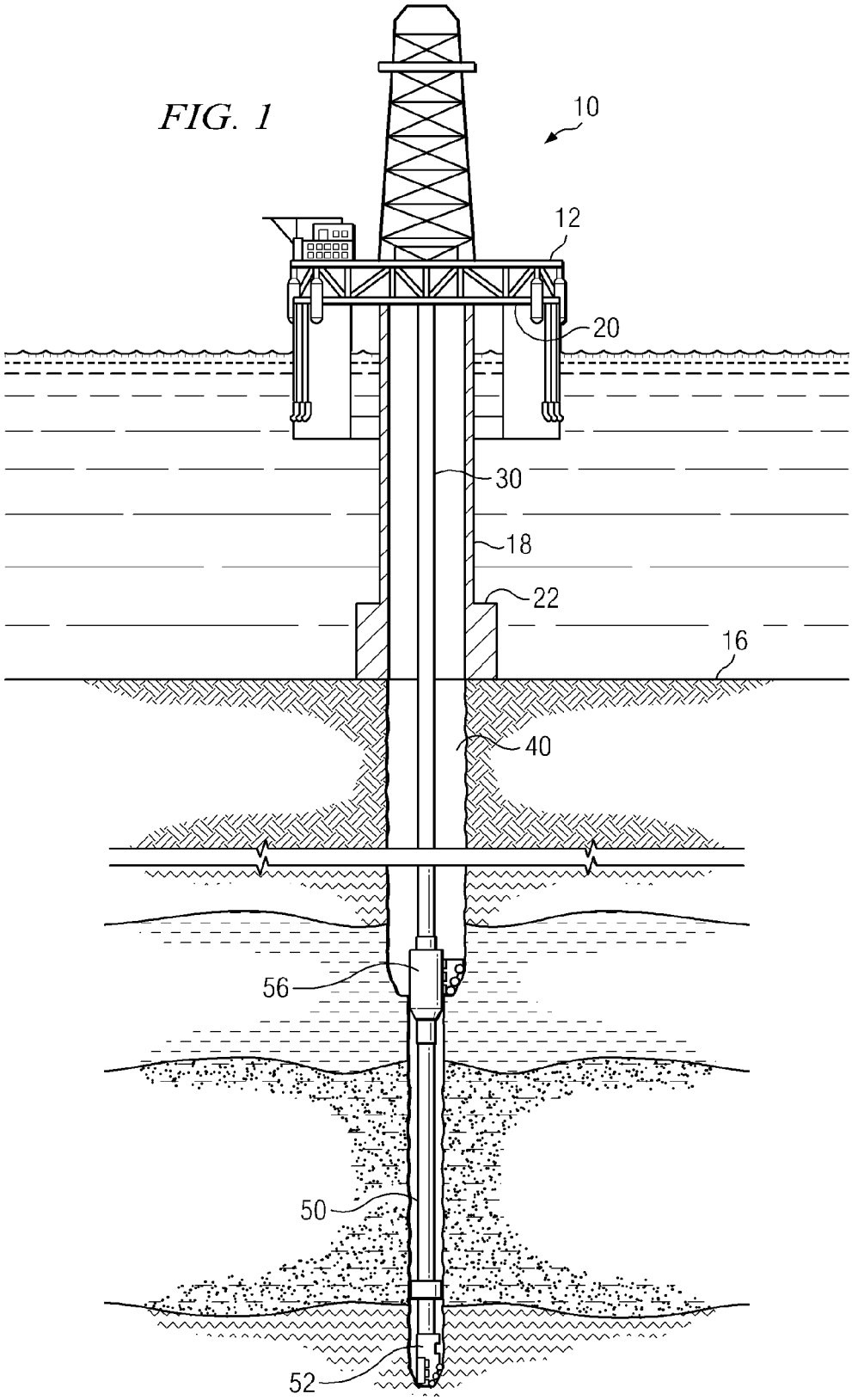
FIG. 1 depicts a conventional drilling rig on which exemplary method embodiments of the present invention may be utilized.

FIG. 1 depicts one exemplary embodiment of a bottom hole assembly (BHA) 50 including first and second cutting structures in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering the drill string 30, which, as shown, extends into borehole 40 and includes BHA 50. In the exemplary embodiment depicted, the BHA includes a first cutting structure 52 (e.g., a conventional drill bit) deployed at a lower end of the drill string 30 and a second cutting structure 56 (e.g., a conventional hole opener or underreamer) deployed above the bit. Drill string 30 may further include, for example, a downhole drilling motor, a steering tool, stabilizers, and/or one or more of numerous other MWD and LWD sensors for sensing downhole characteristics of the borehole and the surrounding formation. These other components are commonly deployed between the first and second cutting structures 52 and 56, although the invention is by no means limited in these regards.

It will be understood by those of ordinary skill in the art that the deployment depicted on FIG. 1 is merely exemplary for purposes of describing the invention set forth herein. It will be further understood that methods in accordance with the present invention are not limited to use with a semisubmersible platform as illustrated on FIG. 1. The inventive methods are equally well suited for use with any kind of subterranean drilling operation, either offshore or onshore.

Figure 2:
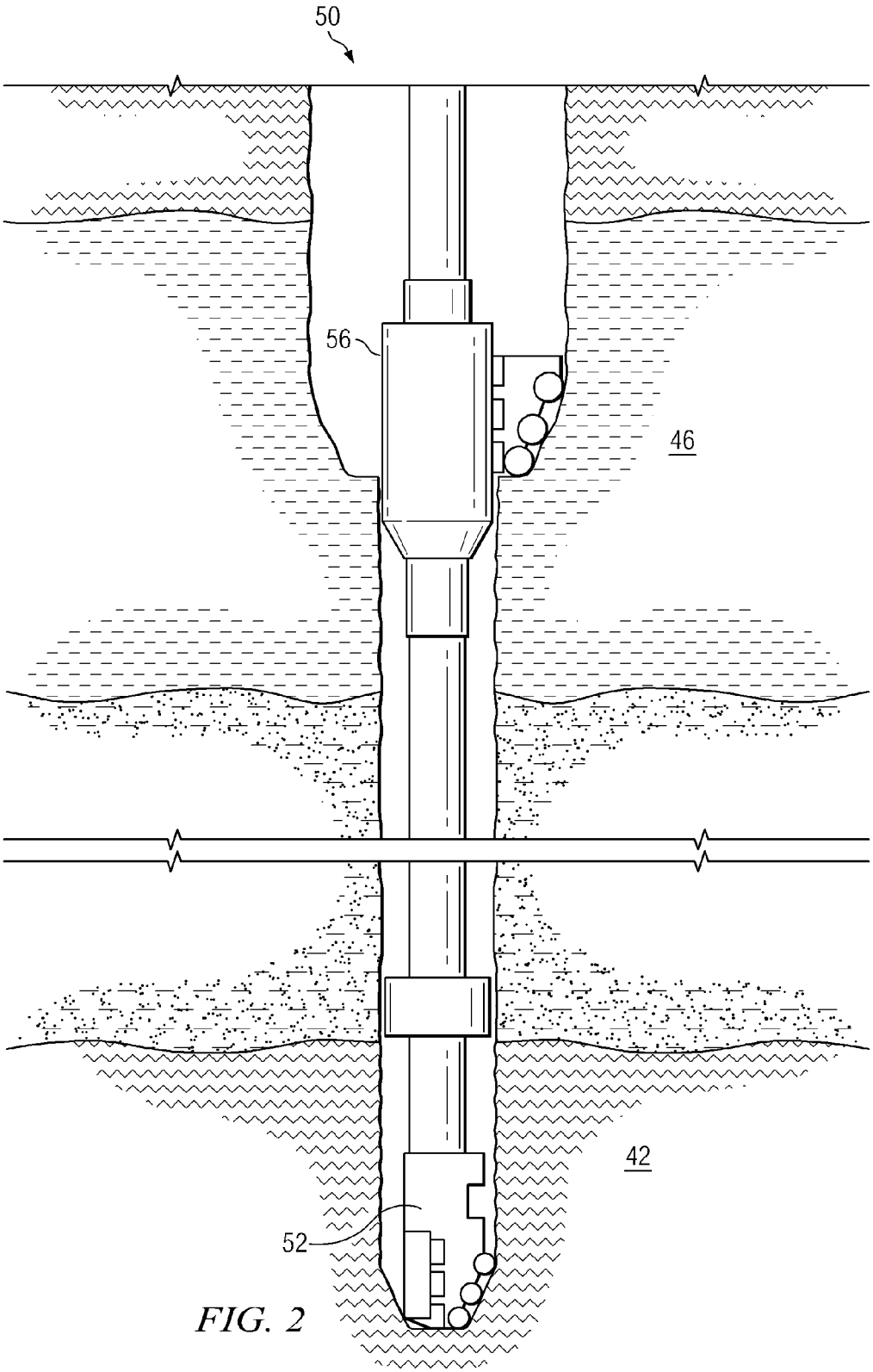
FIG. 2 depicts the bottom hole assembly shown on FIG. 1.

FIG. 2 depicts a portion of BHA 50 shown on FIG. 1. BHA 50 includes a first cutting structure, e.g., a drill bit 52, deployed at a lower end of the drill string 30. Drill bit 52 may include substantially any type of drill bit suitable for subterranean drilling operations, for example including a fixed-cutter (or fixed-head) bit, a roller cone bit, or a percussion bit. Those of ordinary skill in the art will appreciate that conventional fixed-cutter bits (commonly referred to as PDC bits) typically include a cutting head having a plurality of ribs (or blades) arranged about a rotational axis of the bit. Cutting elements (e.g., polycrystalline diamond compacts—PDC) are deployed in the ribs and are disposed to engage the formation as the bit is rotated. Roller cone bits typically include a plurality of roller cones mounted on corresponding journals. The roller cones are disposed to rotate with respect to a bit body and include cutting elements deployed in the surface of the cones. Rotation of the bit causes a corresponding rotation of the cones, which in turn causes the cutting elements to engage the formation. In percussion or hammer drilling operations, the drill bit simultaneously rotates and impacts the earth in a cyclic fashion to crush, break, and loosen formation material. In such operations, the mechanism for penetrating the formation tends to be of an impact nature, rather than shearing. The percussion bit body typically includes a lower cutting face having a plurality of cutting elements that extend downward from the cutting face. These elements are disposed to engage and break up the formation upon impact. It will be understood that the invention is not limited to any particular drill bit configuration.

FIG. 2 further depicts a second cutting structure 56, for example, a conventional hole opener or underreamer deployed above the drill bit 52 in BHA 50. Those of ordinary skill in the art will readily appreciate that hole openers and underreamers are commonly utilized during drilling in borehole enlargement operations. While the invention is by no means limited by such terminology, the term "hole opener" as used in the industry commonly refers to a cutting structure having fixed cutting blades while the term "underreamer" commonly refers to a cutting structure having extendable and retractable cutting blades.

The second cutting structure may include substantially suitable hole opener or underreamer configuration for increasing the diameter of the borehole. For example, the second cutting structure 56 may include a conventional hole opener of the insert cutter, fixed cutter, tooth cutter, or roller cone cutter type. The second cutting structure 56 may also include an underreamer such as a conventional drilling-type or wing (blade) type underreamer. Drilling type underreamers may include multiple hinged arms with roller cone cutters attached thereto. The extendable and retractable cutting arms are commonly mechanically and/or hydraulically actuated and are configured to swing out on a pivot from a recess in the tool body into cutting engagement with the borehole wall. Winged underreamers typically include at least one longitudinally extending "wing" or blade that projects radially outwardly from the tool body. The blades include cutting elements and may be fixed to the tool body or may be configured to be extendable outward from the tool body. It will be understood that the invention is not limited to any particular hole opener or underreamer configuration.

In the exemplary embodiment depicted, the second cutting structure 56 is longitudinally spaced uphole from the first cutting structure 52. While not depicted on FIG. 2, those of ordinary skill in the art will readily appreciate that various other tools are commonly deployed between the first and second cutting structures in the BHA. For example, steering tools, measurement while drilling tools, and logging while drilling tools are commonly deployed between a drill bit and an underreamer (so as to be positioned as close to the bit as possible). In such deployments, the underreamer is by necessity deployed well above the drill bit, for example, on the order of about 50 to 100 feet or more above the bit (the invention is not limited to any particular axial separation). Owing to the stratigraphic nature of geological formations, the first and second cutting structures, as indicated on FIG. 2, routinely engage distinct formation lithologies having distinct physical properties (e.g., lithologies having distinct rock strengths, porosities, densities, compositions, etc). For example, in the exemplary embodiment depicted, the first cutting structure 52 is depicted as engaging a first formation type 42 (e.g., a shale) while the second cutting structure 56, being located uphole from the first cutting structure 52, is depicted as engaging a second formation type 46 (e.g., limestone).

Figure 3:
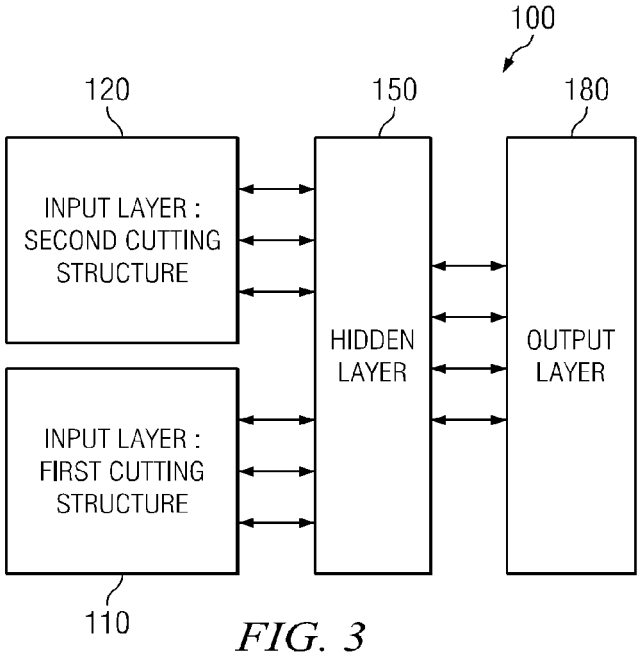
FIG. 3 depicts one exemplary embodiment of an artificial neural network in accordance with the present invention.

FIG. 3 depicts one exemplary embodiment of a trained artificial neural network (ANN) 100 in accordance with the present invention for drilling optimization of a BHA including first and second cutting structures (e.g., bit 52 and underreamer 56 depicted on FIG. 2). The ANN 100 includes first and second parallel input layers 110 and 120 corresponding to the first and second cutting structures. These input layers 110 and 120 are interconnected with a hidden layer 150 (hidden neurons) which is in turn interconnected with an output layer 180. The depicted ANN preferably makes use of a multi-layer back-propagation architecture and supervised learning (as described in more detail below). Those of skill in the art will appreciate that the interconnections (synapses) between the input 110 and 120, hidden 150, and output 180 layers typically include nonlinear functions that enable the ANN to handle highly complex nonlinear problems.

The ANN depicted on FIG. 3 is trained to determine relationships between input variables in the input layers 110 and 120 and output variables in the output layer 180. A "training data set" used to train the ANN typically includes multiple input variable(s) (in the input layer) and at least one output variable (in the output layer). For example, the training data set may include data taken from previously drilled wellbores located in the geographic vicinity of a wellbore to be drilled. After the training data set has been loaded, a computed output layer may be compared with the empirical values of the output variables. Differences between computed and empirical values may then be back-propagated through the network and used to adjust selected interconnections between the input layers 110 and 120 and the hidden layer 150 and/or between the hidden layer 150 and the output layer 180. This process may be repeated any number of times until the differences between the computed and empirical output variables are low enough to satisfy the operator.

With continued reference to FIG. 3, the first and second input layers 110 and 120 each include a plurality of input variables. The first input layer 110 typically includes input variables related to the first cutting structure while the second input layer 120 typically includes input variables related to the second cutting structure. In the exemplary embodiment depicted, the input variables in each of the input layers 110 and 120 may be generally thought of in two broad categories (although the invention is by no means limited in this regard): (i) formation properties in which the cutting structure is deployed and (ii) design parameters of the cutting structure. At least one (and often both) of the input layers 110 and 120 typically further includes input variables of a third category: (iii) drilling operating parameters. These input variables are now described in more detail.

The input variables in input layers 110 and 120 may include substantially any suitable formation properties. For example, these formation properties may include, individually or in combination, but are not limited to mineral composition (lithology), primary porosity (fractional volume of pore space), secondary porosity, permeability, rock compressive strength (confined or unconfined), rock shear strength, principal stresses and/or strains, rock abrasiveness, impact potential, intergranular cementing agents, types and concentrations of fluids disposed in the pore spaces, compressive to shear acoustic velocity ratios as well as any other rock mechanical properties such as Poisson's ratio, Young's, bulk, and/or shear compressibility moduli, angle of internal friction, an formation fluid pressure and differential pressure between the formation fluid pressure and hydrostatic pressure of the drilling fluid at the depth of the formation.

The input variables in input layers 110 and 120 may also include substantially any suitable cutting structure design parameters. The parameters in input layer 110 are typically related to the design parameters of the first cutting structure (e.g., the drill bit) while those in input layer 120 are typically related to the design parameters of the second cutting structure (e.g., an underreamer). When the cutting structure is a drill bit, the input variables may include, for example, individually or in combination: (i) the bit diameter, depth, and type, (ii) the cutting structure including the number, type, size, shape, pattern, and material of construction of the cutting elements, (iii) the hydraulic nozzle design and placement about the face and gauge areas of the drill bit "junk slot" area, "junk slot" geometry, total face volume for drill cuttings removal, cleaning and cooling of the bit cutting structure, (iv) the face blade design including the blade count, blade shape, geometry, and profile, (v) the bearing design including bearing materials, geometry, and load requirements, (vi) the lubrication design including lubricant type and properties, and (vii) the seal design including seal dimensions, material(s), placement, and pressure requirements.

When the cutting structure is a hole opener or an underreamer, the input variables may include, for example, individually or in combination: (i) the hole opener or underreamer diameter, depth, and type, (ii) the cutting structure including the number, type, size, shape, pattern, and material of construction of the cutting elements, (iii) the number and type of cutting blades, including the blade shape, profile, and geometry, and (iv) the blade actuation and retraction mechanism (for underreamers), including pivot, piston, and wing type blades.

At least one of the input layers 110 and 120 typically further includes one or more of the aforementioned drilling operating variables. These variables may include, for example, individually or in any combination thereof, the axial force applied to the bit (commonly referred to in the art as weight on bit—WOB), the rotational speed of the drill string, the torque applied to the drill string, drilling fluid circulation rate through the drill bit, drilling fluid type, drilling fluid density, hydraulic horsepower, standpipe pressure, and other drilling fluid properties such as plastic viscosity, yield point, solids content, fluid loss parameters, gel strength, and the like.

With further reference to the exemplary embodiment depicted on FIG. 3, the output layer 180 typically includes one or more output variables related to the drilling performance. These output variables may include, for example, any one or a combination of the following: the drilling rate of penetration (ROP) (i.e., the rate of progress of the well boring operation, usually measured in feet or meters per hour), the total wear or wear rate of the cutting structures, vibration of the drill string in the borehole, for example, including axial vibration (bit bounce), lateral vibration, torsional vibration (stick slip), and whirl. The output variables may further include, for example, directional control (i.e., maintenance of the well path along a predetermined trajectory), steerability, total distance drilled including a prediction of expected remaining distance, total time drilled including a prediction of expected remaining time, and the like.

Figure 4:
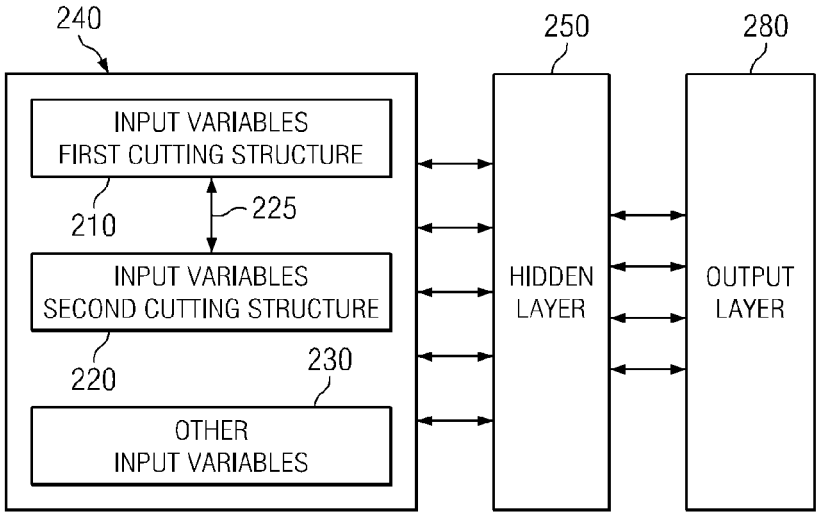
FIG. 4 depicts an alternative embodiment of an artificial neural network in accordance with the present invention.

FIG. 4 depicts an alternative embodiment of a trained ANN 200 in accordance with the present invention for drilling optimization of a BHA including first and second cutting structures (e.g., bit 52 and underreamer 56 depicted on FIG. 2). The ANN includes a combined input layer 240 interconnected with a hidden layer 250 (hidden neurons) which is in turn interconnected with an output layer 280. The depicted ANN may incorporate a similar neuron, synapse, and back-propagation architecture to ANN 100 described above with respect to FIG. 3. Moreover, the input 240 and output layers 280 may include, for example, similar input and output variables to those described above with respect to FIG. 3.

With continued reference to FIG. 4, input layer 240 includes input variables pertaining to the first cutting structure 210, input variables pertaining to the second cutting structure 220, and may optionally further include other input variables 230. Input variables 210 and 220 are combined with one another (as depicted at 225) in the sense that at least one of the input variables pertaining to the first cutting structure 210 is processed in combination with at least one of the input variables pertaining to the second cutting structure 220 to obtain a combined input variable.

In one advantageous embodiment of the invention, a value of a design parameter for the first cutting structure may be processed in combination with a value of the same or a different design parameter for the second cutting structure to obtain a combined design parameter. For example, in one preferred embodiment, a cutting area of the first cutting structure may be combined with a cutting area of the second cutting structure to obtain a combined cutting area (e.g., a ratio, an average, or a weighted ratio or average). The combined design parameter may be further processed in combination with a drilling operating parameter to obtain a combined drilling operating parameter. For example, a total WOB (e.g., as measured at the surface) may be divided between the first and second cutting structures such that the first the cutting structure bears a first portion of the total weight and the second cutting structure bears a second portion of the total weight. The weight borne by each of the cutting structures may be computed, for example, based on a ratio of the cutting areas (or cutting diameters) of the first and second cutting structures. Thus, for example, if the first cutting structure has a larger area than the second cutting structure, it may be determined to bear a larger proportion of the total WOB. Determination of the weight on each of the cutting structures may further take into account other factors such as the formation type in which each of the cutting structures is deployed. For example, when the first and second cutting structures are deployed in corresponding formations having the same or similar properties (e.g., the compressive strength of the rock), the weights may be determined using a simple area ratio. However, when the first and second cutting structures are deployed in corresponding formations having different properties, the weights may be determined using additional factors (e.g., a weighted area ratio or via a ratio or weighted ratio of the compressive strengths of the corresponding formations). Those of skill in the art will appreciate that a cutting structure deployed in a soft formation such as sandstone tends to bear a smaller proportion of the total weight than a cutting structure deployed in a hard formation such as a salt or shale.

It will be understood that the invention is not limited to the combined design parameters described above. Numerous other combined design parameters may also be advantageously utilized. For example, a number of cutting elements on the first cutting structure may be combined with a number of cutting elements on the second cutting structure to obtain a combined input variable (e.g., via an average, a ratio, or weighted ratio of the number of elements). Likewise, an aggressiveness factor of the first cutting structure may be combined with an aggressiveness factor of the second cutting structure to obtain a combined aggressiveness factor. Such an aggressiveness factor may quantify (or be correlated with) the aggressiveness of the cutting structures and may be computed, for example, from a number of design parameters of the cutting structures (e.g., including cutting area, number of cutting elements, type of cutting elements, and the like).

While FIGS. 2-4 depict exemplary embodiments including two cutting structures (e.g., a drill bit and a hole opener or underreamer as depicted on FIG. 2), it will be understood that the invention is not limited in this regard. Methods in accordance with the present invention may be configured for use with substantially any number of cutting structures (three, four, or even more cutting structures). For example, exemplary methods in accordance with the invention may be configured for use with a BHA having first, second, and third cutting structures (e.g., a drill bit, a first underreamer for enlarging the borehole, and a second underreamer for further enlarging the borehole). In the exemplary embodiment depicted on FIG. 3, ANN 100 may further include, for example, a third parallel input layer corresponding to the third cutting structure interconnected with the hidden layer 150. Likewise, in the exemplary embodiment depicted on FIG. 4, input layer 240 of ANN 200 may further include additional input variables corresponding to the third cutting structure. One or more of these additional input variables may be further optionally combined with one or more of either or both of the input variables 110 and 120 corresponding to the first and second cutting structures as described above with respect to FIG. 4.

It will be appreciated that the artificial neural networks 100 and 200 depicted on FIGS. 3 and 4 may be further utilized in combination with a real time drilling optimization system so as to provide for drilling optimization while drilling. For example, in one such embodiment the output layers 180 and 280 from ANNs 100 and 200 are provided as input into the real time drilling optimization system. Suitable drilling optimization systems are disclosed in commonly assigned U.S. Pat. No. 7,142,986 and commonly assigned, co-pending U.S. patent application Ser. No. 11/670,696 (U.S. Patent Publication 2007/0185696), both of which are fully incorporated by reference herein.

Figure 5:
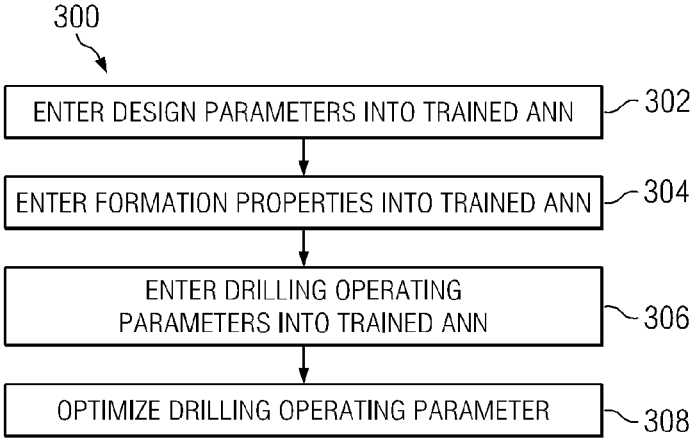
FIG. 5 depicts a flow chart of one exemplary method embodiment in accordance with the present invention.

FIG. 5 depicts a flow chart of one exemplary method embodiment 300 in accordance with the present invention. At 302 a plurality of drilling system design parameters are entered into a trained ANN (e.g., 100 or ANN 200 depicted on FIGS. 3 and 4). The drilling system includes at least first and second longitudinally spaced cutting structures, for example, as depicted on FIG. 2, and the design parameters include at least one design parameter for the first cutting structure and at least one design parameter for the second cutting structure. These design parameters may include substantially any suitable parameters, for example, the design parameters described above with respect to input layers 110 and 120 in FIG. 3. At 304 values of at least one property of an earth formation to be drilled by the drilling system are entered into the trained ANN. At 306 at least one drilling operating parameter is entered into the trained ANN. Suitable properties (in 304) and operating parameters (in 306) are also described above, for example, with respect to input layers 110 and 120 in FIG. 3.

In preferred embodiments of the invention, step 302 may further include processing a design parameter of the first cutting structure in combination with a design parameter of the second cutting structure to obtain a combined design parameter. The combined design parameter may also be entered into the ANN. Step 306 may further include processing a drilling operating parameter in combination with a design parameter of the first cutting structure and a design parameter of the second cutting structure to obtain a combined drilling operating parameter. This combined drilling operating parameter may also be entered into the ANN. Step 306 may alternatively and/or additionally include processing a drilling operating parameter in combination with a property of the earth formation, a design parameter of the first cutting structure, and a design parameter of the second cutting structure to obtain a combined drilling operating parameter.

At 308 a value of the drilling operating parameter is adjusted in response to an output of the trained ANN in order to optimize the drilling operating parameter. In certain embodiments, the drilling operating parameter (or parameters) may be adjusted so as to provide a desired drilling performance. The drilling performance may be determined, for example, according to any one or any combination of the output variables 180 described above with respect to FIG. 3. For example, the drilling operating parameter may be adjusted so as to achieve a high ROP. Alternatively, the drilling operating parameter may be adjusted so as to achieve minimal bit wear, or a suitable combination of a high ROP and a low bit wear. In other alternative embodiments, the drilling operating parameter may be adjusted so as to achieve minimal BHA vibration.

Figure 6:
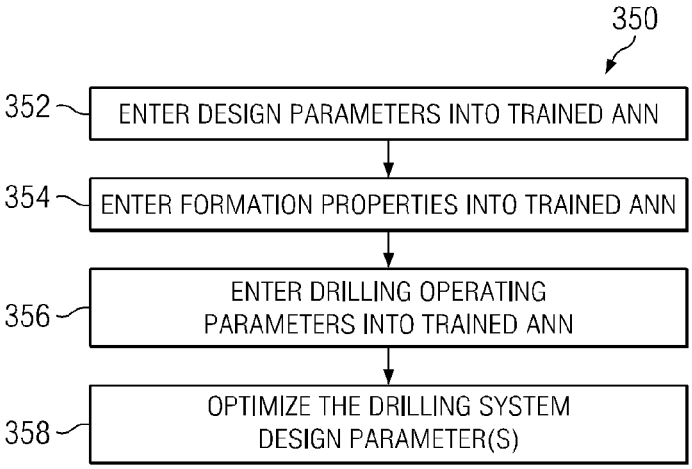
FIG. 6 depicts a flow chart of another exemplary method embodiment in accordance with the present invention.

FIG. 6 depicts a flow chart of another exemplary method embodiment 350 in accordance with the present invention. At 352, a plurality of drilling system design parameters are entered into a trained ANN (e.g., 100 or ANN 200 depicted on FIGS. 3 and 4). The drilling system includes at least first and second longitudinally spaced cutting structures, for example, as depicted on FIG. 2 and the design parameters include at least one design parameter for the first cutting structure and at least one design parameter for the second cutting structure. These design parameters may again include substantially any suitable parameters, for example, the design parameters described above with respect to input layers 110 and 120 in FIG. 3. At 354 values of at least one property of an earth formation to be drilled by the drilling system are entered into the trained ANN. At 356 at least one drilling operating parameter is entered into the trained ANN. Suitable properties (in 354) and operating parameters (in 356) are also described above, for example, with respect to input layers 110 and 120 in FIG. 3. In certain preferred embodiments of the invention steps 352 and 356 may further include processing to obtain a combined design parameter or a combined drilling operating parameter as described above with respect to steps 302 and 306 on FIG. 5.

At 358 a value of at least one of the drilling system design parameters is adjusted in response to an output of the trained ANN in order to optimize the drilling system design parameter. In certain embodiments, the drilling operating parameter (or parameters) may be adjusted so as to provide a desired drilling performance. The drilling performance may be determined, for example, according to any one or any combination of the output variables 180 described above with respect to FIG. 3.

Figure 7:
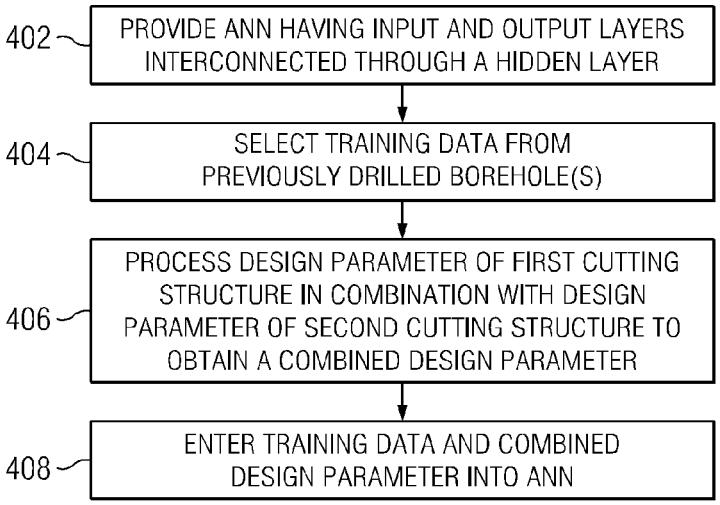
FIG. 7 depicts a flow chart of a method for training an ANN in accordance with the present invention.

FIG. 7 depicts a flow chart of a method embodiment 400 for training an ANN in accordance with the present invention. At 402, an artificial neural network is provided, for example, including input and output layers interconnected though a hidden layer. At 404 training data is selected from at least one previously drilled borehole (and preferably from a plurality of previously drilled boreholes). The training data includes corresponding values of a plurality of drilling system design parameters, at least one formation property for formations through which the previously drilled borehole penetrated, at least one drilling operating parameter, and at least one drilling performance parameter. These parameters are described in more detail above with respect to FIGS. 3 and 4. The drilling system design parameters include at least one design parameter for a first cutting structure and at least one design parameter for a second cutting structure deployed in a the drilling system.

At 406, at least one design parameter of the first cutting structure is processed in combination with at least one design parameter of the second cutting structure to obtain at least one combined design parameter. These design parameters may be further processed, for example, in combination with one or more of the formation properties and the drilling operating parameters to obtain a combined drilling operating parameter. The training data and the combined design parameter are entered into the ANN at 408. The combined drilling operating parameter may also be entered into the ANN at 408.

Although the present invention and its advantages have been described in detail, it should be understood that various changes, substitutions and alternations can be made herein without departing from the spirit and scope of the invention as defined by the appended claims.

We claim:

1. A method for optimizing a drilling operating parameter for a drilling system, the method comprising:

(a) entering a plurality of drilling system design parameters into a trained artificial neural network, the drilling system including first and second longitudinally spaced cutting structures on a single drill string, the design parameters including design parameters for the first cutting structure and design parameters for the second cutting structure, and processing at least one the design parameters of the first cutting structure in combination with at least one the design parameters of the second cutting structure to obtain at least one combined design parameter; and entering the at least one combined design parameter into the trained artificial neural network;

(b) entering at least one property of an earth formation to be drilled by the drilling system into the trained artificial neural network;

(c) entering at least one drilling operating parameter into the trained artificial network; and (d) adjusting a value of the at least one drilling operating parameter in response to an output of the trained artificial neural network so as to optimize said drilling operating parameter.

2. The method of claim 1, wherein:

the at least one of the design parameters of the first cutting structure comprises a first cutting area;

the at least one of the design parameters of the second cutting structure comprises a second cutting area; and the at least one combined design parameter comprises a ratio of the first cutting area to the second cutting area, and further comprising adjusting at least one of the design parameters to optimize the design parameter.

3. The method of claim 1, wherein (c) further comprises:

(i) processing the at least one drilling operating parameter in combination with at least one of the design parameters of the first cutting structure and at least one of the design parameters of the second cutting structure to obtain at least one combined drilling operating parameter; and (ii) entering the at least one combined drilling operating parameter into the trained artificial neural network.

4. The method of claim 1, wherein (c) further comprises:

(i) processing the at least one drilling operating parameter in combination with a first value of the at least one property of the earth formation in which the first cutting structure is deployed and a second value of the at least one property of the earth formation in which the second cutting structure is deployed to obtain at least one combined drilling operating parameter; and (ii) entering the at least one combined drilling operating parameter into the trained artificial neural network.

5. The method of claim 4, wherein the at least one property of the earth formation comprises formation rock strength and the combined drilling operating parameter comprises a ratio of the first and second values.

6. The method of claim 1, wherein (c) further comprises:

(i) processing the at least one drilling operating parameter in combination with the at least one property of the earth formation, at least one of the design parameters of the first cutting structure, and at least one of the design parameters of the second cutting structure to obtain at least one combined drilling operating parameter; and (ii) entering the at least one combined drilling operating parameter into the trained artificial neural network.

7. The method of claim 1, wherein the first cutting structure is a drill bit and the at least one design parameter of the first cutting structure comprises at least one of cutting area, cutting diameter, type of cutting structure, number of cutting elements, type of cutting elements, and hydraulic nozzle configuration.

8. The method of claim 1, wherein the second cutting, structure is a hole opener or an underreamer and the at least one design parameter of the second cutting structure comprises at least one of cutting area, cutting diameter, type of cutting structure, number of cutting elements, and type of cutting elements.

9. The method of claim 1, wherein the at least one property of the earth formation comprises at least one of rock compressive strength, rock shear strength, porosity, mineral composition, acoustic velocity, natural gamma radiation, electrical resistivity, and abrasiveness.

10. The method of claim 1, wherein the at least one drilling operating parameter comprises at least one of weight on bit, rotary speed, drilling fluid flow rate, and drilling fluid circulating pressure.

11. The method of claim 1, wherein the output of the trained artificial neural network comprises at least one of drilling rate of penetration, a wear rate of the first cutting structure, a wear rate of the second cutting structure, and vibration of the drill string.

12. A method for optimizing a drilling system, the method comprising:

(a) entering a plurality of drilling system design parameters into a trained artificial neural network, the drilling system including first and second longitudinally spaced cutting structures on a single drill string, the design parameters including design parameters for the first cutting structure and design parameters for the second cutting structure and processing at least one the design parameters of the first cutting structure in combination with at least one the design parameters of the second cutting structure to obtain at least one combined design parameter; and entering the at least one combined design parameter into the trained artificial neural network;

(b) entering at least one property of an earth formation to be drilled by the drilling system into the trained artificial neural network;

(c) entering at least one drilling operating parameter into the trained artificial neural network; and (d) adjusting values of the drilling system design parameters, including design parameters of the first and second longitudinally spaced cutting structures, in response to an output of the trained artificial neural network so as to optimize the drilling system design parameters.

13. The method of claim 12, wherein (d) further comprises adjusting a value of the at least one combined design parameter in response to an output of the trained artificial neural network so as to optimize the combined design parameter.

14. The method of claim 12, wherein (c) further comprises:

(i) processing the at least one drilling operating parameter in combination with at least one of the design parameters of the first cutting structure and at least one of the design parameters of the second cutting structure to obtain at least one combined drilling operating parameter; and (ii) entering the at least one combined drilling operating parameter into the trained artificial neural network.

15. The method of claim 12, wherein (c) further comprises:

(i) processing the at least one drilling operating parameter in combination with a first value of the at least one property of the earth formation in which the first cutting structure is deployed and a second value of the at least one property of the earth formation in which the second cutting structure is deployed to obtain at least one combined drilling operating parameter; and (ii) entering the at least one combined drilling operating parameter into the trained artificial neural network.

16. The method of claim 12, wherein (c) further comprises:

(i) processing the at least one drilling operating parameter in combination with the at least one property of the earth formation, at least one of the design parameters of the first cutting structure, and at least one of the design parameters of the second cutting structure to obtain at least one combined drilling operating parameter; and (ii) entering the at least one combined drilling operating parameter into the trained artificial neural network.

17. The method of claim 12, wherein the first cutting structure is a drill bit and the at least one design parameter of the first cutting structure comprises at least one of cutting area, cutting diameter, type of cutting structure, number of cutting elements, type of cutting elements, and hydraulic nozzle configuration.

18. The method of claim 12, wherein the second cutting structure is a hole opener or an underreamer and the at least one design parameter of the second cutting structure comprises at least one of cutting area, cutting diameter, type of cutting structure, number of cutting elements, and type of cutting elements.

19. A method for training an artificial neural network, the method comprising:

(a) providing an artificial neural network;

(b) selecting training data from at least one previously drilled borehole, the training data including corresponding values of a plurality of drilling system design parameters, the drilling system design parameters including, at least one design parameter for a first cutting structure and at least one design parameter for a second cutting structure, where the first cutting structure and second cutting structure are located on a single drill string, and wherein the at least one of the design parameters of the first cutting structure comprises a first cutting area; the at least one of the design parameters of the second cutting structure comprises a second cutting area; and the at least one combined design parameter comprises a ratio of the first cutting area to the second cutting area;

(c) processing the at least one design parameter of the first cutting structure in combination with the at least one design parameter of the second cutting structure to obtain at least one combined design parameter;

(d) entering the at least one combined design parameter into the artificial neural network; and (e) adjusting the at least one combined design parameter in response to an output of the artificial neural network.

20. The method of claim 19, wherein:

the training data further comprises corresponding values of at least one drilling operating parameter; and (c) further comprises processing the at least one drilling operating parameter in combination with the at least one design parameter of the first cutting structure and the at least one design parameter of the second cutting structure to obtain the at least one combined drilling operating parameter.

21. The method of claim 19, wherein:

the training data further comprises corresponding values of at least one drilling operating parameter and at least one formation property for formations through which the previously drilled borehole penetrated; and (c) further comprises processing the at least one drilling operating parameter in combination with a first value of the at least one property of the earth formation in which the first cutting structure is deployed and a second value of the at least one property of the earth formation in which the second cutting structure is deployed to obtain the at least one combined drilling operating parameter.

22. The method of claim 21, wherein the at least one property of the earth formation comprises formation rock strength and the combined drilling operating parameter comprises a ratio of the first and second values.

23. The method of claim 19, wherein:

the training data further comprises at least one formation property for formations through which the previously drilled borehole penetrated, at least one drilling operating parameter, and at least one drilling performance parameter; and (c) further comprises processing the at least one drilling operating parameter in combination with the at least one property of the earth formation, the at least one design parameter of the first cutting structure, and the at least one design parameter of the second cutting structure to obtain the at least one combined drilling operating parameter.

24. A method for optimizing a drilling operating parameter, for a drilling system, the method comprising:

(a) acquiring a plurality of drilling system design parameters, the drilling system including first and second longitudinally spaced cutting structures on a single drill string, the design parameters including at least one design parameter for the first cutting structure and at least one design parameter for the second cutting structure;

(b) processing the at least one design parameter of the first cutting structure in combination with the at least one design parameter of the second cutting structure to obtain at least one combined design parameter, wherein the combined design parameter comprises a ratio of a first cutting area corresponding to the first cutting structure to a second cutting area corresponding to the second cutting structure;

(c) entering the at least one combined design parameter into a trained artificial neural network;

(d) entering at least one property of an earth formation to be drilled by the drilling system into the trained artificial neural network;

(e) entering at least one drilling operating parameter into the trained artificial neural network; and (f) adjusting a value of the at least one drilling operating parameter in response to an output of the trained artificial neural network so as to optimize said drilling operating parameter.

* * * * *